United States Patent [19]

Dammel et al.

[11] 3,959,644

[45] May 25, 1976

[54] APPARATUS FOR ADJUSTABLY POSITIONING AN AIR-COOLED DEVICE

[75] Inventors: Wilfried Dammel, Nauheim; Gunter Diessel, Mainz-Lerchenberg, both of Germany

[73] Assignee: Feinmechanische Werke Mainz GmbH, Mainz-Mombach, Germany

[22] Filed: Oct. 29, 1974

[21] Appl. No.: 518,721

[30] Foreign Application Priority Data

Oct. 29, 1973 Germany ..... 2354070

[52] U.S. Cl. ..... 240/47; 240/52 R

[51] Int. Cl.[2] ..... F21V 29/00

[58] Field of Search ..... 240/47, 52 R, 1 R, 61.11, 240/61.12, 61.13, 67, 71

[56] References Cited

UNITED STATES PATENTS

| | | | |
|---|---|---|---|
| 2,574,211 | 11/1951 | Hill | 240/61.13 |
| 2,932,210 | 4/1960 | Kaighin et al. | 240/61.11 X |
| 3,101,038 | 8/1963 | Archer | 240/47 X |
| 3,482,918 | 12/1969 | Nederlof et al. | 240/47 X |

*Primary Examiner*—R. L. Moses

*Attorney, Agent, or Firm*—Webb, Burden, Robinson & Webb

[57] ABSTRACT

An apparatus comprising a housing having a cylindrical guide opening therefrom and a driven winding drum journaled therein. A pretensioned elastic tape, for example, stainless steel, is wrapped on the drum and extends through the cylindrical guide such that it forms a rigid air conducting tube. The air cooled device is fixed to the free end of the tube and cooled by air drawn through the tube.

7 Claims, 9 Drawing Figures

16
16
23'
22
10
13
3
10
1
14
21
5
10
9
15
3
16
8
13
24
23
2
3
7

3
6
17
16
11
12
18
3
4
18
19
25
20
18
18

Fig.2a
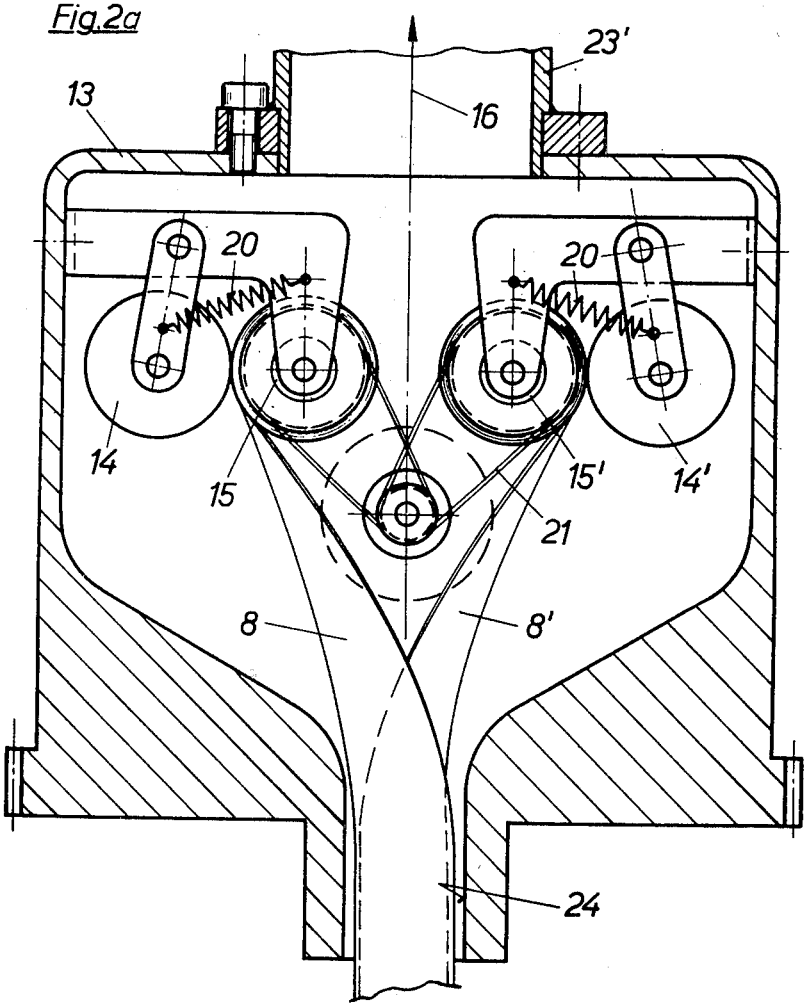
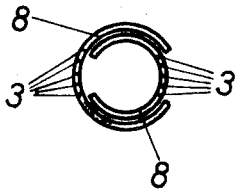
Fig. 2b

APPARATUS FOR ADJUSTABLY POSITIONING AN AIR-COOLED DEVICE

The invention relates to an apparatus for remotely controllable and programmable positioning of air-cooled devices, more particularly studio flood lights, which are adjustable in elevation, are rotatable about a vertical axis and swingable about a horizontal axis.

Up to the present time, complicated adjusting devices have been available to position studio flood lights that are based on the scissors (or lazy tongs) or telescoping principle which together with electric cables and air-cooling hoses suspended therefrom which result in awkward and bulky apparatus difficult to maintain, and whose reliability leaves much to be desired.

It is an object of this invention to provide adjusting equipment which is simple in design, takes up little space, and makes it possible, without additional expense, to supply cooling air to or provide a suction of warm air from the devices that are to be positioned. At the same time the positioning apparatus is to be remotely controllable and programmable.

Briefly, according to this invention, an apparatus for adjustably positioning an air-cooled device includes a housing which is rotatably mounted to be rotated by a drive motor. The housing is connected to an air blower or air suction device. This housing contains a motor driven winding drum associated with a spring mounted pressure drum. A flexible, preformed or pretensioned elastic winding tape runs off the winding drum and through a cylindrical guide opening from the housing such that due to the tapes preformation and pretension the tape is transformed into a stiff air-conducting tube. At the free end of the tube is secured a motor drive or remotely operated swingable holding device for the air-cooled device that is to be positioned.

For practical purposes, the electric lines for the drive motor of the swingable device and/or air-cooled device are designed as members that are secured to the winding tape or are built thereinto and the said lines are wound or unwound together with the tape.

A second winding tape or a number of winding tapes may be assigned to individual associated winding drums in such a way that the two or more winding tapes overlap one another oppositely offset from one another in a common tubular shape.

The drive motor of the winding drum may be designed as a continuously running electric motor coupled to a counting device, the counting impulses of the counting device being proportional to the length of tube that is fed out of the housing.

The drive motor of the winding drum may, however, also be designed as a stepping motor, the number of the prescribed incremental steps being proportional to the length of tube that is fed out of the housing.

Three exemplifying embodiments of the invention will now be explained and described with the aid of the drawings.

Figures 1A, 1B, 1C:
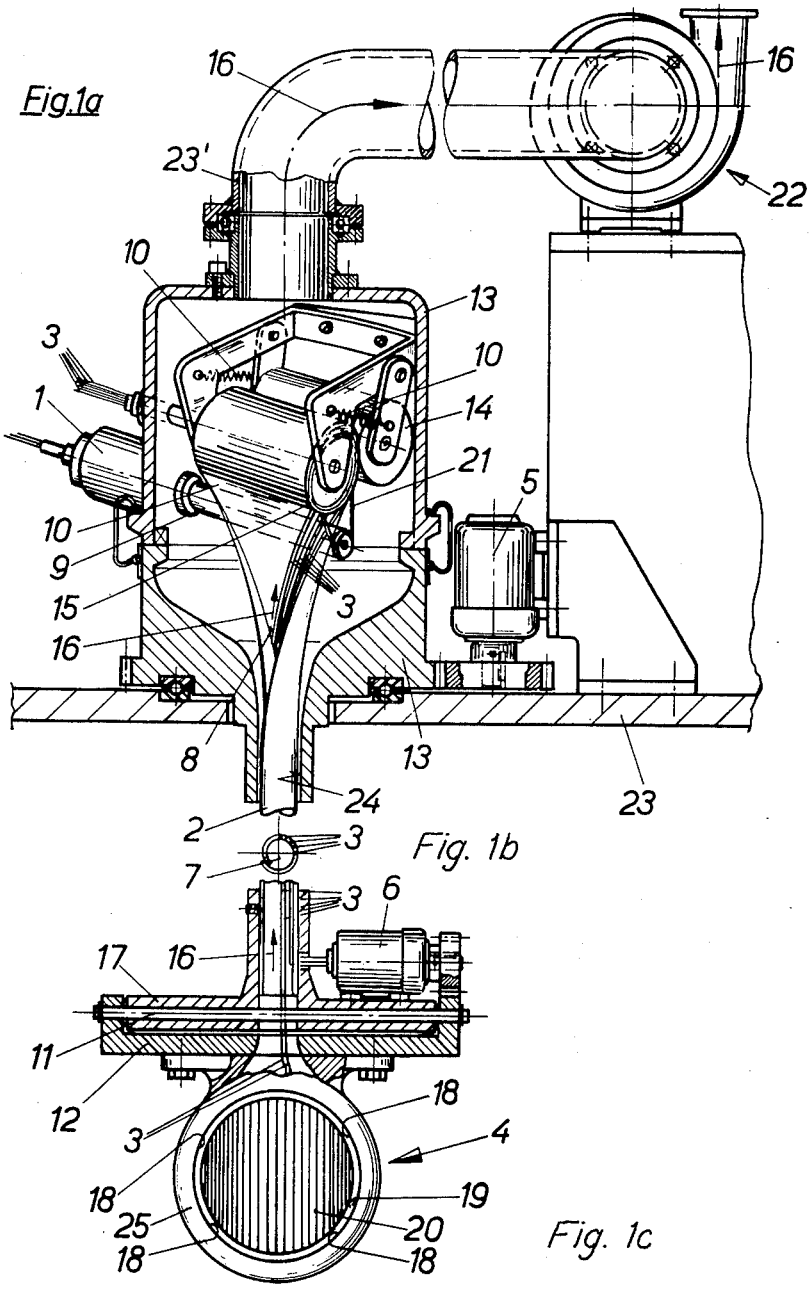
Figure 3B:
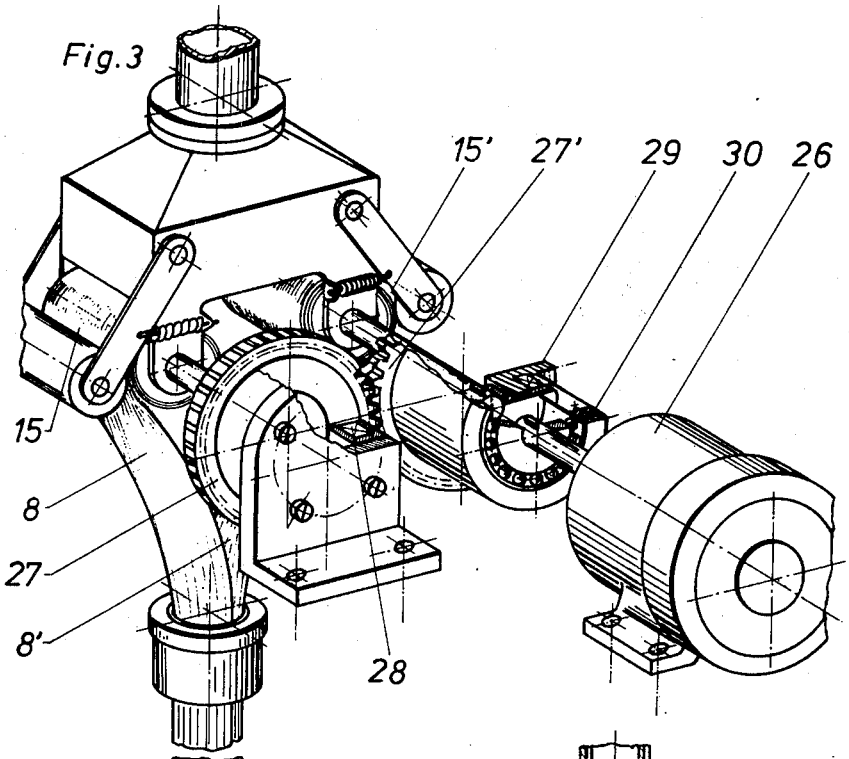
Figure 3B:
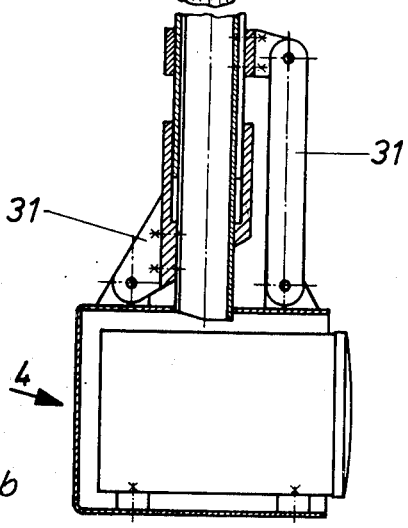
Figure 3A:
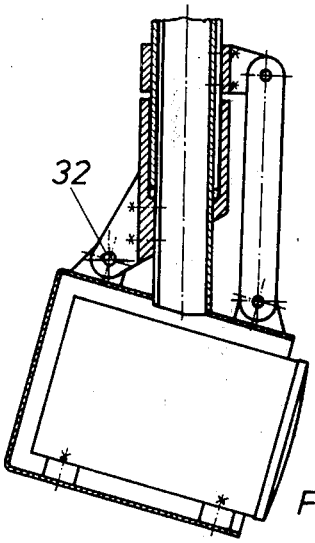
Figure 4:
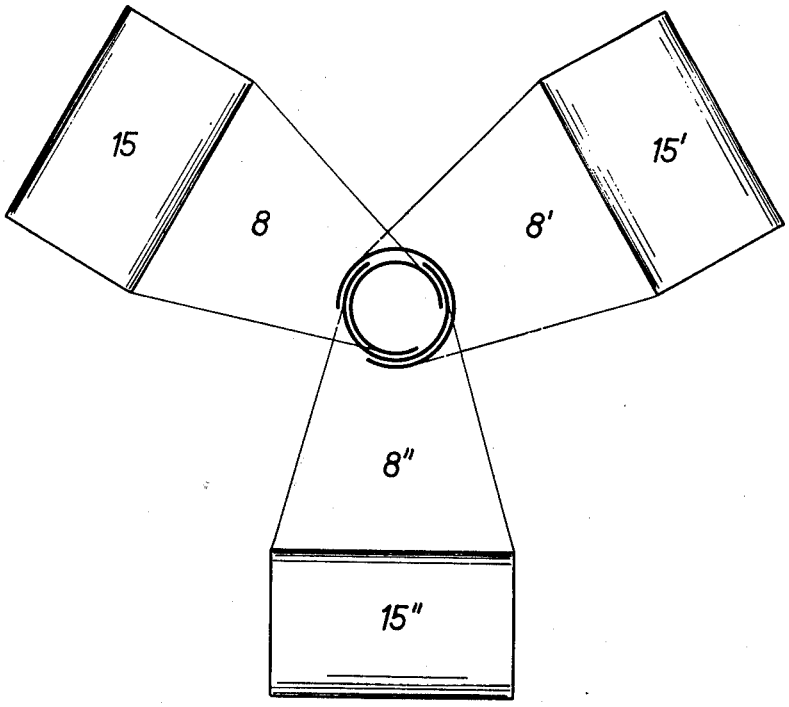

FIG. 1*a* is a longitudinal section through the housing of one embodiment having one winding drum;

FIG. 1*b* is a section through the tube 2;

FIG. 1*c* is a partial section through the swingable holding device and air-cooled flood light;

FIG. 2*a* is a longitudinal section through the housing of a second exemplifying embodiment having two winding drums;

FIG. 2*b* is a section through the tube comprising two tapes;

FIGS. 3, 3*a* and 3*b* illustrate the subject matter of FIG. 2 with a drive; and FIG. 4 is a schematic showing in plan view of a third embodiment having three winding drums.

A first exemplifying embodiment of the invention illustrated in FIG. 1 comprises a housing 13 rotatably mounted by conventional means in a stationary member or base 23. The housing 13 contains a winding drum 15 journaled therein on which is wound a tape 8 of flexible preformed or pretensioned elastic material. The tape emerges from housing 13 through a cylindrical guide 24 and in so doing, is transformed as the result of its preformation and pretension into a tube 2 whose longitudinal edges overlap one another. Stainless steel may be used, for instance, as a suitable material. The air-cooled device 4 is secured to the free end of the tube as hereafter explained.

The winding drum 15 may, for example, be set in rotation by way of a transmission member 21 by means of a drive roller 9 journaled in the interior of housing 13. Drive roller 9 is driven by a drive motor 1 disposed on the outside of housing 13. A pressure drum 14 is swingably journaled in the interior of housing 13 and is pressed against winding drum 15 by means of a tension spring 10 so that tape 2, which is tubular in its unstressed state will be wound upon winding drum 15 as a flat tape 8.

A drive motor 5 secured to stationary member 23 sets housing 13 in rotative motion about a vertical axis by a gear drive so that housing 13 can be rotated together with tube 2 secured. Air cooled device 4 disposed at the lower free end of the tube is thereby rotated with the housing.

Disposed at the lower free end of tube 2 is a holding device fixed member 17 and secured thereto a holding device swingable member 12 rotatable about a horizontal pin 11. The air-cooled device 4 is secured to the swingable member 12. By means of a drive motor 6 secured to the fixed member 17, device 4 may be swung about horizontal rotating pin 11 by way of a gear drive.

Thus, the three drive motors 1, 5 and 6 which can be remotely controlled and programmed making possible an elevational adjustment that is continuous or stepped enables a rotating movement about a vertical axis and a swinging movement about a horizontal axis. A further horizontal movement may be achieved by continuously moving the member 23 (which has been described as stationary) in the horizontal direction by means that are not shown but are well known.

Between the heat-generating studio flood light 20 and a correspondingly shaped, suitably designed receiving housing 25, a slotted opening 19 may be provided into which the outside air is sucked in the direction of arrows 18. The heated cooling air then moves upwardly in the direction of arrows 16 in the interior 7 of tube 2. Conduit 23' connects the housing and an air suctioning device 22 (fan).

For practical purposes, the electrical lines 3 that are required for device 4 and drive motor 6 are secured in flattened form to the outside of winding tape 8 or are incorporated into the tape so that the cable 3 and winding tape 8 can be wound up together on winding drum 15.

FIG. 2 illustrates a second embodiment in which two winding drums 15 and 15' are journaled opposite to one another and turn on parallel axes. The two winding tapes 8 and 8' are thus wrapped around one another and when being unwound form a rigid, airtight tube.

FIG. 3 illustrates a modified embodiment of FIG. 2. The winding drums 15 and 15' do not rotate together since the transmission 21 of FIG. 2 has been omitted. The unwinding of the tapes 8 and 8' and consequently also the elevational adjustment of device 4 is accomplished for winding drum 15' by means of drive motor 26 by way of gear 27' and for winding drum 15 by way of gear 27 which meshes with gear 27'.

Drive motor 26 also serves to swing device 4 about a horizontal axis 32. To do so, gear 27 and winding drum 15 are blocked by magnetic brake 28. Winding drum 15' is uncoupled from the housing of drive 30 and gear 27' connected thereto by coupling 29. Now drive 26 drives winding drum 15' by way of the inner portion of drive 30. Thus only winding tape 8' is wound or unwound and by way of lever system 31 adjusts the flood light 4.

In order to achieve small changes in the angle of swing, the drive also contains a strong reduction of the drive into "slow."

An even greater rigidity of the tube may be achieved by the third embodiment shown schematically in FIG. 4, in which three winding tapes 8, 8' and 8'' are used and wrap themselves around one another. In this way any desired degree of rigidity and load carrying capacity of tube 2 can be achieved corresponding to the weight of device 4 and the length that is being run out.

The apparatus described can be remotely controlled and programmed when the three electric drive motors 1, 5 and 6 are connected to corresponding electrical signal emitters and counting devices. The said drive motors may also be designed as stepping motors so that the number of the prescribed impulses will be proportional to the run-out length of tube 2. The control signals may be fed in manually and then be converted into electrical signals or they may be read off by a data memory. Thus a programmed positioning system of this type will allow the device that is to be positioned to enter any desired elevational or angular position.

Having thus described our invention with the detail and particularity as required by the patent laws, what is desired and claimed protected by Letters Patent is set forth in the following claims.

1. An apparatus for remotely positioning an air-cooled device such as studio flood lights, comprising a housing having a cylindrical guide opening therefrom, at least one winding drum journaled in said housing, a flexible pretensioned elastic tape wrapped on said drum and passing through said cylindrical guide such that the tape is transformed into a rigid air-conducting tube outside of said housing, said air-cooled device secured to the free end of the tube, means for driving said drum to wrap or unwrap said tape thereon for positioning the air-cooled device toward or away from said housing and a fan associated with said housing for passing air through the housing, tube and air cooled device.

2. An apparatus according to claim 1 wherein a plurality of winding tapes with associated winding drums pass through the cylindrical guide and overlap one another in offset manner to form a common tubular shape outside the housing.

3. An apparatus for remotely positioning an air-cooled device such as studio flood lights, comprising a housing rotatably mounted on a base to turn on a vertical axis and having a cylindrical guide opening therefrom, means for turning said housing about said vertical axis, at least one winding drum journaled in said housing and associated therewith a pressure drum biased against said at least one winding drum, a flexible pretensioned elastic tape wrapped on said at least one winding drum and passing through said cylindrical guide such that the tape is transformed into a rigid air-conducting tube outside of said housing, said air-cooled device secured to the free end of the tube to swing about a horizontal axis, means for turning said device about the horizontal axis, means for driving said winding drum to wrap or unwrap said tape thereon for positioning the air-cooled device toward or away from said housing and a fan associated with said housing for passing air through the housing, tube and air-cooled device.

4. An apparatus according to claim 3 wherein electrical lines for the means for turning the device about the horizontal axis and/or for the device are secured to or incorporated into the winding tape and are wound or unwound together with the tube by the winding drum.

5. An apparatus according to claim 3 in which means for driving the winding drum is a continuous electromotor connected to a counting device, the counting impulses of the counting device being proportional to the length of tape being run out of the housing.

6. An apparatus according to claim 3 in which the means for driving the winding drum is designed as a stepping motor, the number of the prescribed stepping impulses being proportional to the length of tube being run out of the housing.

7. An apparatus for remotely positioning an air-cooled device such as studio flood lights, comprising a housing rotatably mounted on a base to turn on a vertical axis and having a cylindrical guide opening therefrom, means for turning said housing about said vertical axis, at least two winding drums journaled in said housing, a flexible pretensioned elastic tape wrapped on each said drum and passing through said cylindrical guide such that the tape is transformed into a rigid air-conducting tube outside of said housing, said air-cooled device secured to the free end of one said tape, to swing about a horizontal axis and secured by means of a lever to said other tape, means for driving said drums together to wrap or unwrap said tape thereon for positioning the air-cooled device toward or away from said housing, means for driving said drums relative to each other to swing the air-cooled device about its horizontal axis, and a fan associated with said housing for passing air through the housing, tube and air-cooled device.

* * * * *